United States Patent [19]

Decker, Sr.

[11] 4,046,331

[45] Sept. 6, 1977

[54] WIRE ROLLER

[76] Inventor: William Springall Decker, Sr., P.O. Box 671, Stanton, Tex. 79782

[21] Appl. No.: 736,128

[22] Filed: Oct. 27, 1976

[51] Int. Cl.[2] ..... B65H 54/00

[52] U.S. Cl. ..... 242/54 R; 242/58.6; 242/68; 242/81; 242/86.5 R

[58] Field of Search ..... 242/54 R, 58.6, 86.5 R, 242/81, 80, 79, 68, 68.4, 68.3, 56.2, 56.3, 56.4, 56.5, 56.6, 129.6, 129.51

[56] References Cited

U.S. PATENT DOCUMENTS

| | | | |
|---|---|---|---|
| 2,616,637 | 11/1952 | Schroeml | 242/86.5 R |
| 2,624,522 | 1/1953 | Van Hook | 242/58.6 |
| 2,650,771 | 9/1953 | Marion | 242/54 R |
| 3,685,756 | 8/1972 | Marx et al. | 242/56.2 |

*Primary Examiner*—George F. Mautz
*Attorney, Agent, or Firm*—Wendell Coffee

[57] ABSTRACT

The frame of a wire roller includes a beam. An axle on the frame carries arms carrying a spool shaft. The arms are journaled independently on the axle and are raised and lowered by a U-shaped bracket which is controlled by a jack between the beam and the bracket. A drive motor is mounted on one of the arms. The other arm may be independently raised and lowered to facilitate placing a spool on the removable spool shaft.

10 Claims, 6 Drawing Figures

WIRE ROLLER

BACKGROUND OF THE INVENTION

1. Field of the Invention

This invention relates to a support with a driving stub to wind electrical power line wire upon a spool.

2. Description of the Prior Art

In the field or in warehouses, there is a need for a machine to roll wire such as electric power line onto empty spools. Often there will be remnants left on different spools and it is desired to wind them on a single spool.

Previous devices have been developed for this purpose, but they could be characterized by being complex and expensive or simple and requiring excessive man power to operate, particularly to mount the spool upon the spool axle.

SUMMARY OF THE INVENTION

1. New and Different Function

I have invented a wire rolling machine which solves the problem by having the arms which support the spool to be mounted for separate movement upon an axle. The mechanism to raise and lower the arm is provided by a U-shaped bracket. A simple hand operated hydraulic jack moves the bracket. Although it is contemplated that a power cylinder could be substituted for the jack, an extremely simple, inexpensive machine is provided which has all of the operating advantages of far more expensive machines, but, still, costs far less to manufacture.

2. Objects of the Invention

An object of this invention is to wind wire upon a spool.

Further objects are to achieve the above with a device that is sturdy, compact, durable, lightweight, simple, safe, efficient, versatile, and reliable, yet inexpensive and easy to manufacture, adjust, operate, and maintain.

Other objects are to achieve the above with a method that is versatile, rapid, efficient, and inexpensive, and does not require skilled people to adjust, operate, and does not require skilled people to adjust, operate, and maintain.

The specific nature of the invention, as well as other objects, uses, and advantages thereof, will clearly appear from the following description and from the accompanying drawing, the different views of which are not to the same scale.

DESCRIPTION OF THE PREFERRED EMBODIMENT

Figure 1:
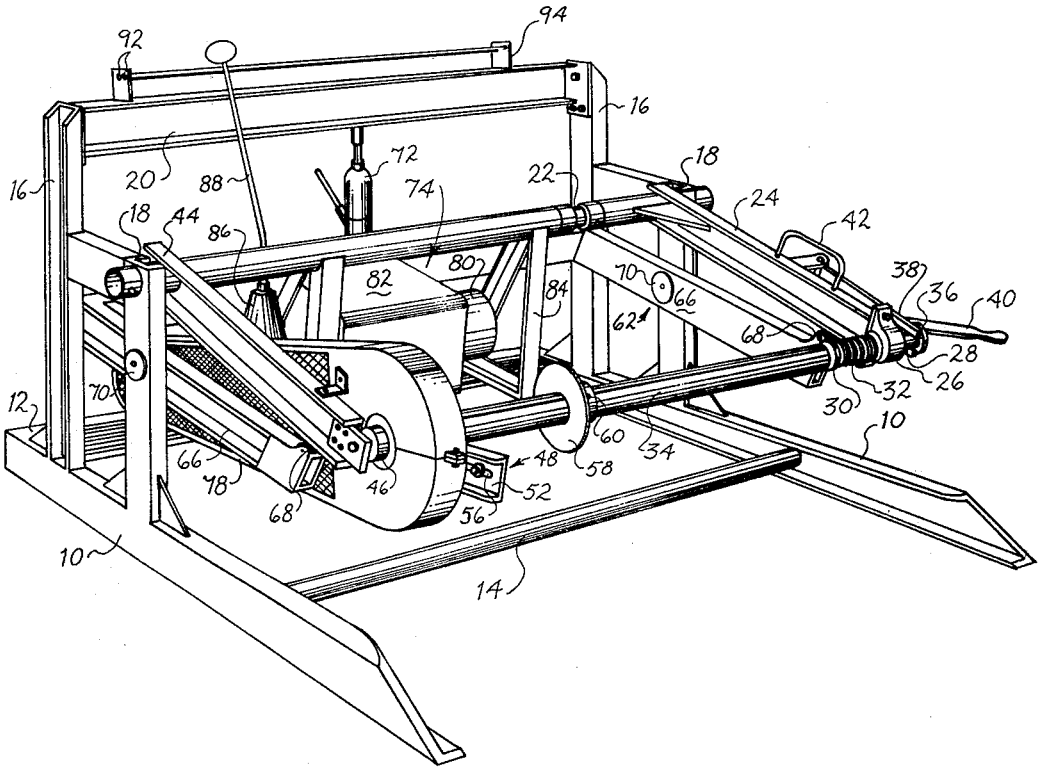
FIG. 1 is a perspective view showing an embodiment of my invention.
Figure 5:
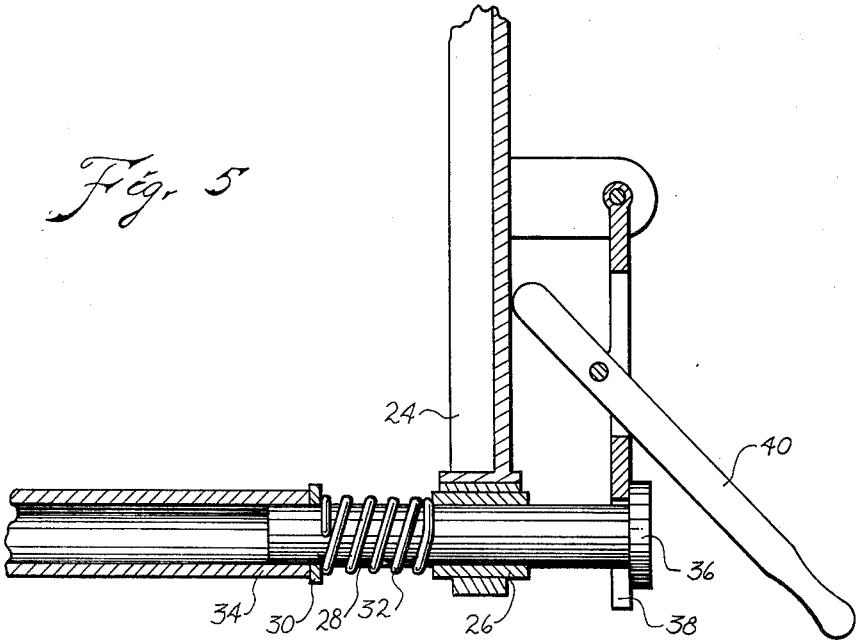
FIG. 5 is a sectional detailed view taken substantially on line 5—5 of FIG. 3.
Figure 2:
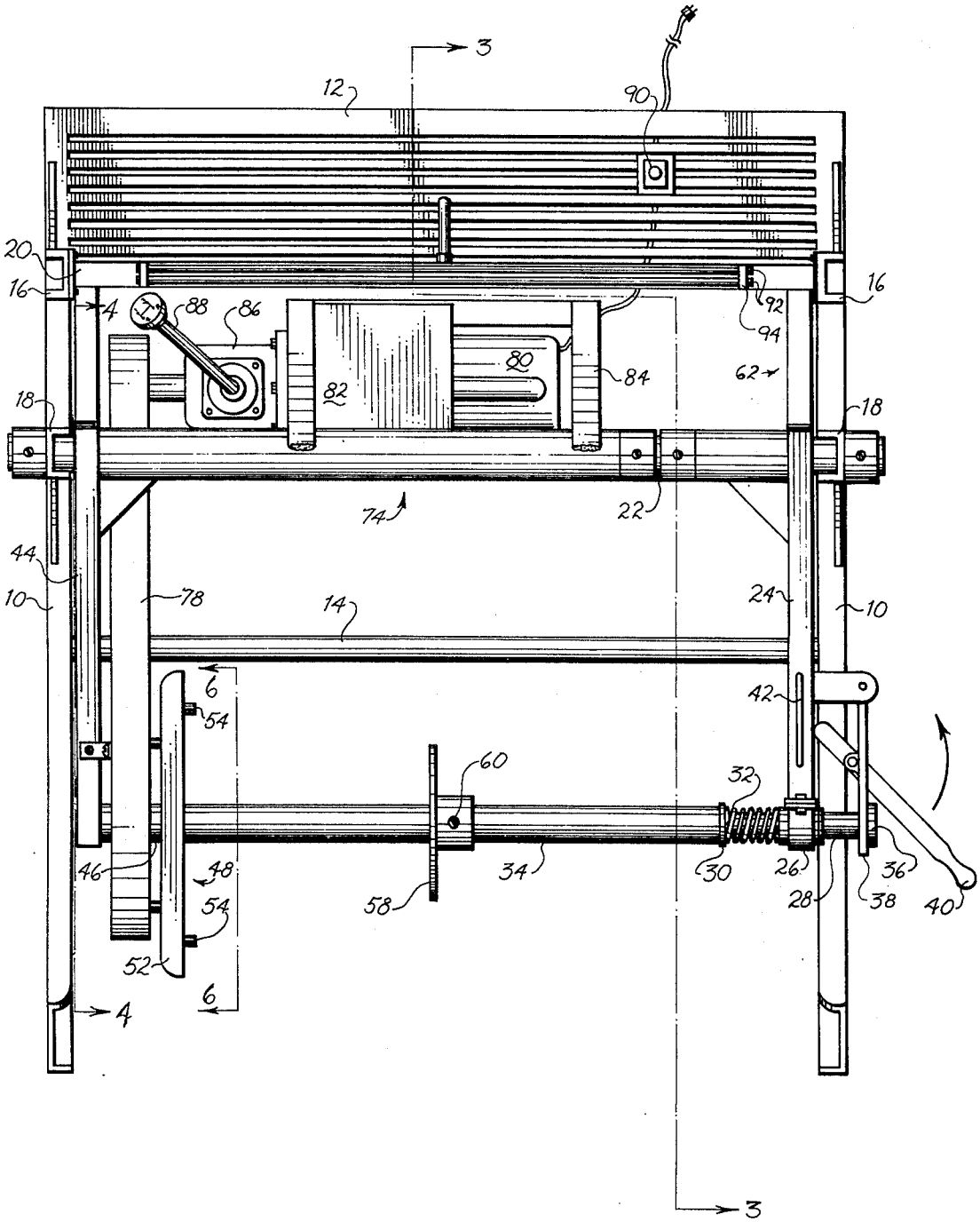
FIG. 2 is a top plan view thereof.
Figure 3:
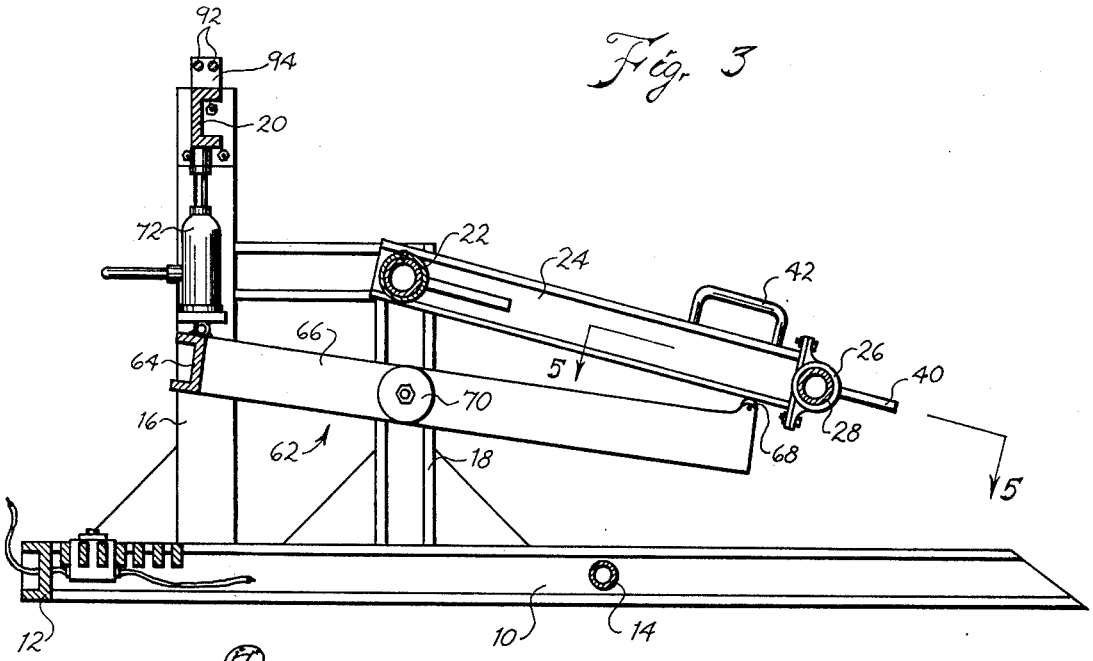
FIG. 3 is a sectional elevational view thereof taken substantially on line 3—3 of FIG. 2.
Figure 4:
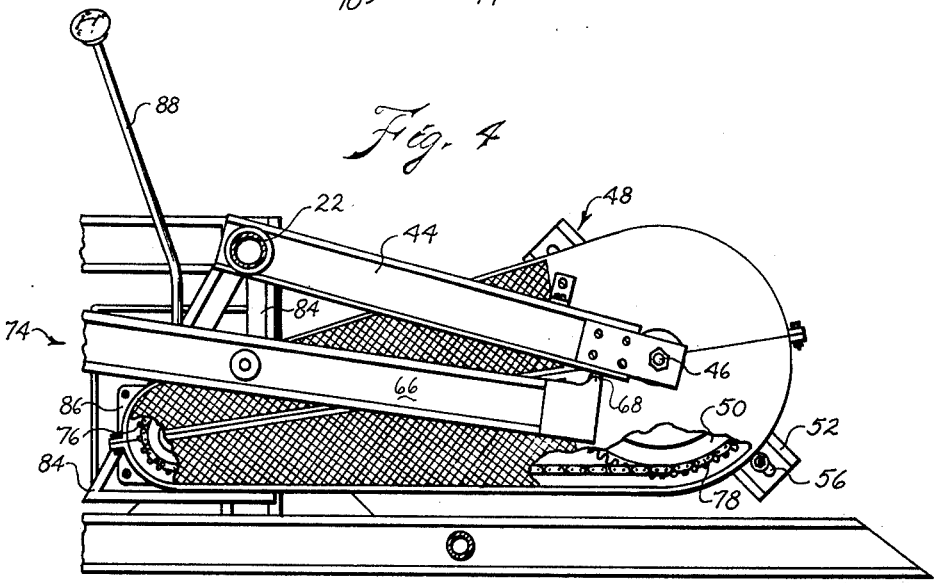
FIG. 4 is a sectional elevational view thereof taken substantially on line 4—4 of FIG. 2.
Figure 6:
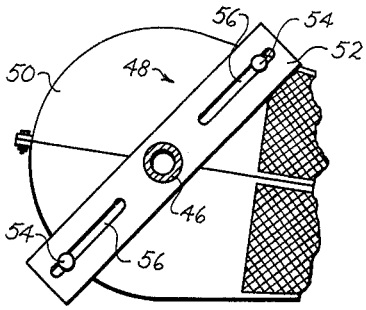
FIG. 6 is a sectional detailed view taken substantially on line 6—6 of FIG. 2.

As may be seen, the machine according to this invention has a frame which rests upon runners 10. The runners are connected by a cross member 12 at the back of the machine and also has middle cross member 14 at midpoint so that a stable base for the machine is formed.

From this base adjacent to the back cross member 12 stand two beam posts 16, these extend vertically up from the runners 10. Forward of them are two axle posts 18. The beam posts and axle posts are braced to the base runners 10 by suitable gussets to one another so a rigid frame is provided. As stated, the axle post is forward of the beam post, thus providing an orientation of the machine. Beam 20 connects the top of the beam posts. Main axle 22 connects the top of the axle post 18. The beam 20 and main axle 22 are horizontal and parallel and the main axle is forward of the beam.

Spindle arm 24 is journaled to the main axle 22. Spindle arm 24 is journaled to the main axle 22. Spindle bearing 26 is attached to the distal end of spindle arm 24. Spindle 28 is journaled in the bearing for rotation. Also, the spindle 28 is mounted for axial sliding movement. Adjacent to the inside end of the spindle, collar 30 provides for a stop for helical compression spring 32 which surrounds the spindle between the bearing 26 and the collar 30. The collar 30 also provides a stop for hollow spool shaft 34. The spindle extends outboard of the spindle arm 24 and on the outboard end thereof is mounted collar 36. Fork 38 is mounted between the collar 36 and the bearing 26 and is actuated by lever 40. It will be readily understood that actuation of the lever 40 will move the fork and thus the spindle outwardly to disengage the end of the spindle from the spool shaft for purposes which are fully explained later. Handle 42 on the spindle arm 24 provides convenient means to raise and lower it.

Power arm 44 is journaled to the main axle 22 on the other end thereof from the spindle arm 24. The power arm likewise has a bearing on the distal end thereof which carries a stub shaft 46 with lug means 48 thereon. The hollow spool shaft 34 telescopes over the stub shaft inasmuch as the spindle 28 and the stub shaft 46 are coaxial when in lowered position. Sprocket 50 on the stub shaft 46 rotates the stub shaft and thus the lug means as explained hereinafter. The lug means includes a crossbar 52 having slot 56 extended therethrough. The crossbar 52 is attached to the stub shaft. The crossbar has lugs 54 adjustably attached in the slot 56 of the crossbar 52. The slots 56 extend radially from the stub shaft 46. Flange 58 is attached by handle locking screw 60 to the spool shaft 34.

Therefore, it may be seen that lever 40 may be manipulated to remove the spool shaft 34 from between the spindle and the stub shaft. The spindle shaft is pivoted upward, getting it out of the way. The spool shaft can be placed through the spool upon which the wire is to be reeled and placed between the runners 10. Then, the arms can be moved up and down so the spool shaft 34 can be placed on the stub shaft 24 and then the spindle arm 24 moved up and down so the spindle 28 can be placed in the spool shaft 34. Handle locking screw 60 may be loosened and the flange 50 fits snugly against the spool and the spool fits snugly against the crossbar 52 of the lug means. The lugs 54 can be adjusted in the slot 56 to mate with holes in the flange of the spool. Therefore, the spool is readily rotatable to wind wire thereon.

Obivously, the spool cannot be rotated while it is resting on the floor; therefore, U-shaped lift bracket 62 is used to lift the arms 24 and 44. The U-shaped lift bracket has bight 64 beneath the beam 20. Lift arms 66 from the bight extend underneath the spindle and power arms 24 and 44. Steel roller 68 on the distal end of the lift arms fit beneath the arms 24 and 44 to raise and lower them. The lift arms 66 are pivoted by coaxial trunnions 70 to the axle post 18. The trunnions 70 are below the main axle 22.

Jack 72 between the bight 64 and the beam 20 provides power to raise or lower the spool as have been described. Obviously the jack 72 can be of many forms, but one convenient form with which I have had good success is an ordinary hydraulic jack which can be hand operated to raise the spool or has a T-handle to release the hydraulic fluid to lower the spool to the floor. Therefore, the spool may be conveniently raised to a desirable winding height and lowered as the wire on the spool builds up. Also, the spool can be lowered against the floor to form a brake in the event it is desired to stop its rotation. Those with ordinary mechanical skill will readily understand that a fluid cylinder connected to a source of fluid under pressure, such as air or hydraulic fluid, could be used instead of the hand jack 72.

Power unit 74 is attached to the main axle 22 and the power arm 44. The power unit rotates power sprocket 76 which by chain 78 drives the sprocket 50. For a mobil unit to be used in the field, a hydraulic power unit would be used. This has the advantage that the power for the unit may be obtained from tractors or trucks, most of which have hydraulic power connections thereon. It is desirable that such power unit would be able to rotate in either direction and also to rotate in reverse. Those with ordinary skill in the art will understand how to connect such a hydraulic power unit so that it would drive the power sprocket 76.

For warehouse use I prefer to use an electrical motor with a multispeed transmission. Electric motor 80 is attached to belt housing 82 which is attached to the axle 22 by suitable power bracket 84. The belt housing contains speed reduction, belt and sheave drive by which the variable speed transmission 86 is driven. The variable speed transmission 86 has capabilities of driving the spool in a forward direction at three speeds or in a reverse direction at a very low speed. The transmission 86 connects the sheaves within the belt housing 82 to the power sprocket 76. Forward speed is that speed wherein the top of the spool moves forward or away, which is to say the wire would be wound over the top of the spool. The forward speed or reverse of the transmission is selected by gear shift lever 88. The housing of transmission 86 is connected to the axle and power arm 44 as shown. Power switch 90 for the electric motor 80 is a foot switch which is mounted behind the machine for the operator for his convenience.

Two rods 92 are attached by ears 94 to the top of the beam 20. These rods 92 form a track for the wire. The operator can mount a guide upon the track or he can mount a meter upon the track so as the guide or meter is moved along the track, the wire is level wound upon the spool. Also, with the meter, the amount of wire is measured. The operation of winding wire upon the spool by the operator using guides and meters is well known. A convenient station for the operator to operate is provided by grating 96 adjacent to the jack 72 and the track formed by the rods 92 with the power switch 90 thereon.

Thus, it may be seen that I have provided a wire roller by which the heavy spools may be raised and lowered and handled without undue strain upon the operator, yet the machine is quite simple and inexpensive to manufacture.

Those skilled in the art will understand that various changes and modifications could be made, e.g., the safety cover over the chains have not been described inasmuch as the provisons for them and their construction is readily understood.

As an aid to correlating the terms of the claims to the exemplary drawing, the following catalog of elements is provided:

| | |
|---|---|
| 10 runner | 54 lugs |
| 12 cross member | 56 slot |
| 14 mid. cross mbr. | 58 flange |
| 16 beam post | 60 handle lock screw |
| 18 axle post | 62 U-shaped lift bracket |
| 20 beam | 64 bight |
| 22 main axle | 66 lift arms |
| 24 spindle arm | 68 steel roller |
| 26 bearing | 70 trunnions |
| 28 spindle | 72 jack |
| 30 collar | 74 power unit |
| 32 spring | 76 sprocket, power |
| 34 spool shaft | 78 chain |
| 36 collar | 80 electric motor |
| 38 fork | 82 belt housing |
| 40 lever | 84 bracket |
| 42 handle | 86 transmission |
| 44 power arm | 88 gear lever |
| 46 stub shaft | 90 switch |
| 48 lug means | 92 rods |
| 50 sprockets | 94 ears |
| 52 crossbar | 96 grating |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. A wire roller comprising:

a. a frame, b. a horizontal beam on the frame, c. a main axle horizontally mounted on the frame parallel to and forward of the beam, d. a spindle arm journaled on one end of the main axle with a distal end forward thereof, e. a power arm journaled on the other end of the main axle with a distal end forward thereof, f. a spindle mounted for rotational and axial movement parallel to the axle on the distal end of the spindle arm, g. spool lug means mounted on the distal end of the power arm for drivingly engaging a spool, h. a hollow spool shaft extending from said spindle to said spool lug means so that a spool may be mounted thereon, j. driving means mounted on main axle and connected to said power arm for rotating said spool lug means, k. a U-shaped lift bracket journaled to the frame by m. trunnions below the main axle, n. said U-shaped bracket having i. a bight under the beam and i. lift arms under the spindle arm and power arms and o. a jack between the bight and beam.

2. The invention as defined in claim 1 with an additional limitation of p. a track mounted on top of said beam whereby wire may be guided along the track to be level wound upon a spool upon the spool shaft.

3. The invention as defined in claim 1 with additional limitations of p. said spindle extending on both sides of said spindle arm, q. a collar on the inboard side of said spindle, r. a helical compression spring between said collar and said bearing, s. biasing the spindle toward the power arm, t. a fork mounted on said spindle arm, u. a collar on the outboard end of the spindle, v. said fork between the outside collar and bearing, and w. a lever interconnecting the spindle arm and fork whereby the fork can be forced outwardly against the collar to pull the spindle away from the power arm.

4. The invention as defined in claim 1 with additional limitations of p. said driving means includes an electric motor drivingly connected to a variable speed transmission, q. said transmission driving a sprocket which is connected to a sprocket on the stub shaft by a chain.

5. The invention as defined in claim 1 with additional limitations of p. a flange mounted for axial movement along the spool shaft, q. handle locking screw on the flange for locking the flange in an adjusted position on the spool shaft.

6. The invention as defined in claim 1 with additional limitations of p. said spool lug means including a stub shaft journaled to said power arm, q. said stub shaft coaxial with said spindle, r. crossbar attached to said stub shaft, s. a slot in said crossbar extending radially from said stub shaft, t. lugs adjustable located in said slot, u. said lugs forming means for engaging a spool on the spool shaft.

7. The invention as defined in claim 6 with an additional limitation of v. a track mounted on top of said beam whereby wire may be guided along the track to be level wound upon a spool upon the spool shaft.

8. The invention as defined in claim 7 with additional limitations of w. said spindle extending on both sides of said spindle arm, x. a collar on the inboard side of said spindle, y. a helical compression spring between said collar and said bearing, z. biasing the spindle toward the power arm, aa. a fork mounted on said spindle arm, bb. a collar on the outboard end of the spindle, cc. said fork between the outside collar bearing, and dd. a lever interconnecting the spindle arm and fork whereby the fork can be forced outwardly against the collar to pull the spindle away from the power arm.

9. The invention as defined in claim 8 with additional limitations of ee. a flange mounted from axial movement along the spool shaft, ff. handle locking screw on the flange for locking the flange in an adjusted position on the spool shaft.

10. The invention as defined in claim 9 with additional limitations of gg. said driving means includes an electric motor drivingly connected to a variable speed transmission, hh. said transmission driving a sprocket which is connected to a sprocket on the stub shaft by a chain.

* * * * *